United States Patent [19]

Ogata et al.

[11] Patent Number: 4,670,726

[45] Date of Patent: Jun. 2, 1987

[54] CONVERGENCE DEVICE FOR ELECTRON BEAMS IN COLOR PICTURE TUBE

[75] Inventors: Masao Ogata; Nobuo Kakinuma, both of Saitama, Japan

[73] Assignee: Hitachi Metals, Ltd., Tokyo, Japan

[21] Appl. No.: 810,219

[22] Filed: Dec. 18, 1985

[30] Foreign Application Priority Data

| | | | |
|---|---|---|---|
| Dec. 20, 1984 | [JP] | Japan | 59-269154 |
| Feb. 28, 1985 | [JP] | Japan | 60-40067 |
| Mar. 13, 1985 | [JP] | Japan | 60-50117 |
| Mar. 13, 1985 | [JP] | Japan | 60-50118 |
| Mar. 19, 1985 | [JP] | Japan | 60-55469 |

[51] Int. Cl.[4] ..... H01F 1/00

[52] U.S. Cl. ..... 335/212; 335/217; 313/427

[58] Field of Search ..... 335/210, 211, 212, 217; 313/421, 427

[56] References Cited

U.S. PATENT DOCUMENTS

| | | | |
|---|---|---|---|
| 3,725,831 | 4/1973 | Barbin | 335/212 |
| 4,117,433 | 9/1978 | Smith | 335/212 |
| 4,490,703 | 12/1984 | Ruth | 335/212 |
| 4,570,140 | 2/1986 | Teruaki | 335/212 |

FOREIGN PATENT DOCUMENTS

| | | | |
|---|---|---|---|
| 55-30659 | 8/1980 | Japan | 335/212 |
| 1429292 | 3/1976 | United Kingdom | 335/212 |

*Primary Examiner*—George Harris

*Attorney, Agent, or Firm*—Finnegan, Henderson, Farabow, Garrett & Dunner

[57] ABSTRACT

A convergence device for electron beams in a color picture tube includes a pair of four-pole magnet rings, a pair of six-pole magnet rings and a pair of two-pole magnet rings, the absolute value of the temperature coefficient of magnetization of which is equal to or less than 0.05%/°C. measured in a temperature range of 0° C. to 120° C.

6 Claims, 15 Drawing Figures

CONVERGENCE DEVICE FOR ELECTRON BEAMS IN COLOR PICTURE TUBE

BACKGROUND OF THE INVENTION

The present invention relates to a static convergence device for in-line electron beams emitted from three guns located at a bottom in a color picture tube.

A static convergence assembly (STC) for use with an in-line color cathode ray tube (Color-CRT) has an effect to make electron beams emitted from guns located at a bottom of a tube, strike coincident regions of a viewing screen.

A STC comprises a pair of juxtaposed four-pole magnet rings and a pair of justaposed six-pole magnet rings which are rotatably mounted about axially spaced regions of the tube neck. The described ring magnet structures may advantageously be used in combination with a pair of juxtaposed two-pole magnet rings called purity rings, each magnetized across a diameter of a ring for effecting movement of all three beams in the same direction, for accomlishing both purity and convergence adjustments. These prior art devices are described in U.S. Pat. No. 3,725,831, British Patent Specification No. 1,429,292 and Japan Patent Publication No. 55-30659.

Previously, four-pole magnet rings and six-pole magnet rings in a STC were composed of a mixture of Ba-ferrite magnetic material and resin material which was called a Ba-ferrite type of plastic magnet.

However, the above-mentioned STC had drawbacks in that the magnet rings caused an undesirable discrepancy of beams on a viewing screen after a temperature change in a STC even after focusing three beams to a point on the viewing screen by adjustments to the STC. The undesirable discrepancy of beams after a temperature change in a STC occurred by reason of the magnetization of the magnet rings comprised of Ba-ferrite type plastic magnet material in the STC which were reduced or enhanced too much by a temperature change of the STC, because the Ba-ferrite type plastic magnet material had rather big temperature coefficient of magnetization as $-0.2\%/°C$.

The temperature coefficient ($\alpha$) of magnetization as used in the specification and drawings of the present invention is defined by a formula:

$$\alpha = \frac{\Phi_b - \Phi_a}{\Phi_a} \times 100/(T_b - Ta)\ (\%/°C.)$$

where $\Phi b$ is the magnetic flux (Maxwell) of the permanent magnet at a temperature of Tb°C. and $\Phi a$ is the magnetic flux (Maxwell) of the permanent magnet at a temperature of Ta°C.

Recently such an undesirable beam discrepancy on a viewing screen which is caused by a rather big temperature coefficient of magnetization of magnet rings in a STC becomes more and more serious in current state of the art high-performance color picture tubes.

SUMMARY OF THE INVENTION

Accordingly, it is an object of this invention to remove the drawbacks of the prior art and to provide a convergence device where changes of magnetic flux in ring magnets in the convergence device according to a temperature change is small, so a discrepancy of beams on a viewing screen caused by the temperature change is satisfactorily suppressed.

This invention is directed to a convergence device comprising a pair of juxtaposed four-pole magnet rings and a pair of juxtaposed six-pole magnet rings which are rotatably mounted about axially spaced regions of a tube neck, wherein at least the four-pole magnet rings are composed of permanent magnet material provided with an absolute value of temperature coefficient of magnetization equal to or less than 0.05%/°C.

DESCRIPTION OF THE PREFERRED EMBODIMENT

The invention will be further understood from the following detailed description and the drawings.

Figure 1:
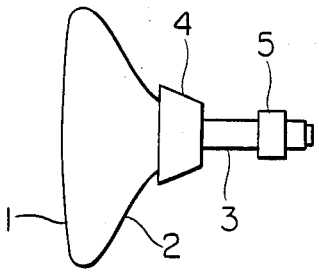
FIG. 1 is a somewhat simplified side view of an in-line, tri-beam shadow-mask color cathode ray tube.
Figure 2:
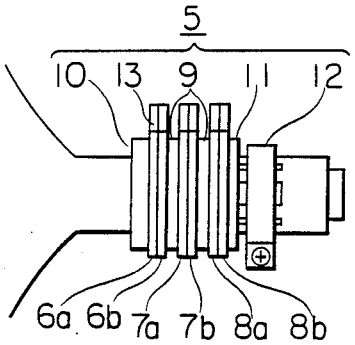
FIG. 2 is an enlarged side view of the STC portion of the tube shown in FIG. 1.

Referring first to FIG. 1 which is a somewhat simplified side view of an in-line, tri-beam shadow-mask color cathode ray tube (CRT), the tube comprises a viewing screen 1, a funnel region 2, a neck 3, a deflection yoke 4, and a static convergence 5 assembly (STC). FIG. 2 is an enlarged side view of the STC portion of the tube shown in FIG. 1, wherein 6*a* and 6*b* illustrate a pair of four-pole magnet rings, 7*a* and 7*b* illustrate a pair of six-pole magnet rings, 8*a* and 8*b* illustrate a pair of two-pole magnet rings called purity rings, each of which is provided with a projection 13 for easy rotation during adjustments. The spacer 9 between the paired four-pole magnet rings 6*a*, 6*b* and the paired six-pole magnet rings 7*a*, 7*b* and the spacer 9 between the paired six-pole magnet rings 7*a*, 7*b* and the purity rings 8*a*, 8*b* serves to prevent a simultaneous rotation of these paired rings.

All the ring magnets and the spacers can be fixed by a press of the stop ring 10 toward the ring part 11 after adjustments of electron beams. A metallic clamp 12 is used to fix the STC on the neck of the CRT.

Figure 3A:
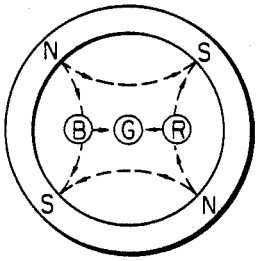
FIGS. 3*a*, 3*b* and 3*c* are diagrammatic showings illustrating various directions of beam position shifts obtainable with various magnet rings of the FIG. 2 device.
Figure 3B:
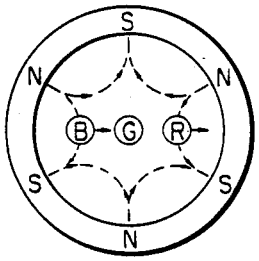
Figure 3C:
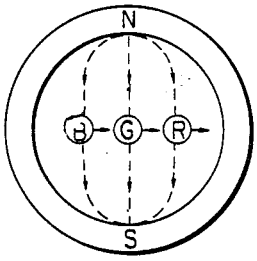
Figure 4A:
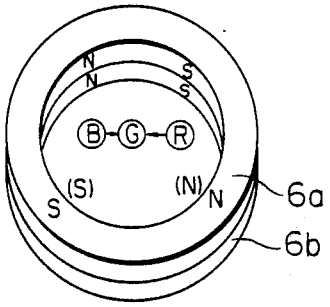
FIGS. 4*a*, 4*b*, 4*c* and 4*d* are diagrammatic showings illustrating how differential rotation of four-pole magnet rings affects beam shift.
Figure 4B:
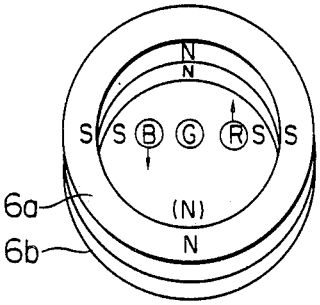

FIGS. 3*a*, 3*b* and 3*c* are diagrammatic showings illustrating various directions of beam position shifts obtainable with a pair of four-pole magnet ring elements, a pair of six-pole magnet ring elements and a pair of two-pole ring elements, respectively. The shift directions of a blue beam (B), a green beam (G) and a red beam (R) are shown by the arrows in the figures. As shown in FIG. 3*a* the side beams (B and R) can be shifted variously to the opposite directions by magnetic fields produced by the paired magnetic rings according to rotational positions of a pair of four-pole magnet ring elements. Beams B and R can be directed to the central beam (G) by a rotational adjustment of the paired magnet rings. It is preferable that the central beam (G) would not be caused to shift by the magnetic field adjustment for the other beams (B and R). Suppression of the temperature change of magnetization of the four-pole magnet rings is most effective for preventing an undesirable discrepancy of beams caused by a temperature change of a STC, because the magnetic field created by the four-pole magnet rings acts on the electron beams. In FIG. 3*b* the shift directions of the beams in a pair of six-pole magnet ring elements are shown. The two outside beams (B and R) move in substantially the same direction by the effect of the magnetic field created by the two magnet rings 7*a* and 7*b*. Preferably the central beam would not be affected by a rotational adjustment of the paired magnet rings. The shift directions of the electron beams in the purity magnet rings are shown in FIG. 3*c*. The three beams move in substantially the same direction according to the relative position of the two magnet rings. The color purity can be adjusted by these beam movements. As explained above, the relative positions of the paired magnet rings determine the shift direction and the shift amount of the electron beams. Although the following explanations concern the paired four-pole magnet rings, similar explanations can also be applied to the paired six-pole magnet rings and paired two-pole magnet rings. FIGS. 4*a*–4*d* illustrate the effect of the relative locations of the two magnet rings 6*a* and 6*b* on movement of the electron beams in the paired four-pole magnet rings. FIG. 4*a* illustrates how the two magnet rings aid each other to provide a maximum amount of movement in the opposite direction of the two outside beams (B and R). In this situation, the field direction at the beam (B) is vertically downward while the field direction at the beam (R) is vertically upward; the resultant beam position shifts are lateral and to the right at the beam (B) and lateral and to the left at the beam (R). The diagrammatic showing of FIG. 4*b* illustrates the nature of the beam position shifts that result from the fields of the four-pole ring pair 6*a* and 6*b* for a particular orientation wherein ring 6*a* is positioned with its north poles directly above and below the axial beam (G) location; ring 6*b* is similarly positioned (whereby the fields of the two rings are similarly directed, and are fully aiding).

With the indicated orientation, the field at the beam (B) is laterally directed with a polarity producing a downward shift of the blue beam. The field at the red beam location is also laterally directed but with opposite polarity, producing an upward shift of the red beam.

Figure 4C:
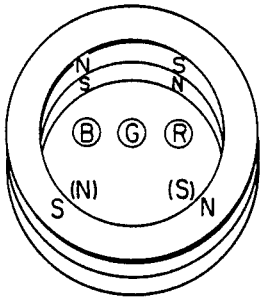

FIG. 4*c* illustrates the two magnet rings 6*a* and 6*b* angularly disposed relative to each other such that their respective magnetic poles are superimposed. This results in an effective cancellation of the magnetic field of each such that there is no movement imparted to the electron beams.

Figure 4D:
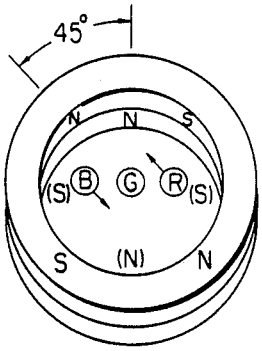

FIG. 4*d* illustrates the magnetic poles of ring magnets 6*a* and 6*b* disposed about 45° C. from each other. This results in opposite diagonally directed beam position shifts (downward and to the right for the blue beam, and upward and to the left for the red beam). The shift amount of the beams is smaller than the one in the configuration in FIG. 4*a* or FIG. 4*b* because some of the magnetic field for each ring magnet is cancelled by the field of the other.

This invention is directed to a static convergence device for use with a Color-CRT having the effect of causing beams emitted from three electron guns to be arrayed in-line at the bottom of the tube, wherein each of the paired four-pole magnet rings, used in combination with a pair of six-pole magnet rings, and preferably with a pair of two-pole magnet rings comprises permanent magnets made of metallic magnetic material inserted or fixed at the pole positions of a ring which is non-magnetic or magnetic, or a permanent magnet which is a mixture of metallic magnetic material and a bonding agent as a polymeric material, wherein the permanent magnets are provided with absolute temperature coefficients ($\alpha$) of magnetization equal to 0.05%/°C. or less than 0.05%/°C. measured in a temperature range of 0° C. to 120° C., in order to prevent an undesirable discrepancy of beams caused by temperature change in a STC.

In the present invention, the magnets in the paired six-pole magnet rings or the magnets in the paired two-pole magnet rings also can be composed of a magnet having a low temperature coefficient. The utilization of the magnets having a low $|\alpha|$ value in the paired six-pole magnet rings and also in the paired two-pole magnet rings in combination with the paired four-pole magnet rings having a low $|\alpha|$ value are preferable to prevent a discrepancy of beams caused by a temperature change in the STC.

The magnets used in this invention have an absolute temperature coefficient equal to or less than 0.05%/°C. The reasons for the temperature coefficient range of magnetization of the magnets to be used for the paired ring magnets are the following. The original Ba-ferrite type of plastic magnet material is provided with a temperature coefficient of magnetization of about −0.2%/°C. which causes about 16% of magnetic flux reduction by a temperature rise ($\Delta T$) of 80° C.

In the case of a STC comprising paired four-pole magnet rings, paired six-pole magnet rings and paired two-pole magnet rings, all of which are made of Ba-ferrite type of plastic magnet material to enable a shift of side beams by 4 mm, a 0.64 mm in the position discrepancy of the side beams after a temperature change of 80° C. would occur. This discrepancy magnitude is too great in current state of the art high-performance color picture tubes. In the same CRT, the discrepancy magnitude of side beams caused by the same temperature change would be reduced to a value of less than 0.16 mm by the use of ring magnets having an absolute temperature coefficient of magnetization equal to or less than 0.05%/°C. in the four-pole magnet rings.

Examples of preferable metallic materials having a temperature coefficient of magnetization less than that of Ba-ferrite type of plastic magnet material are Cunife, Vicalloy, Alnico or Fe-Cr-Co. As Cunife has a rather high temperature coefficient of about 0.09%/°C. and Vicalloy comprises about 50 weight % of Co which is expensive and not economical, Alnico or Fe-Cr-Co, having a temperature coefficient of magnetization of about 0.01 to 0.03%/°C., is preferred to be used as a magnet material for the magnet rings according to the present invention.

As is known to persons skilled in the technical area, the temperature coefficient of magnetization of a Fe-Cr-Co magnet greatly depends on its magnet shape.

The temperature coefficient ($\alpha$) of magnetization of a Fe-Cr-Co magnet is negative when measured at a point of infinite permeance coefficient, for example at the point of Br, but the absolute value of the negative temperature coefficient becomes smaller as the permeance coefficient of the magnet becomes smaller.

As stated above, a Fe-Cr-Co magnet is a characteristic in that its temperature coefficient of magnetization reverses at a critical point of a permeance coefficient (Pc) even if the magnet is composed of the same composition provided with the same hysteresis characteristic.

Because of the above stated reasons, it is possible to obtain an extremely low temperature coefficient of a Fe-Cr-Co magnet if the proper shape of the magnet is chosen. The preferable shapes of Fe-Cr-Co magnets are those with a diameter of 1.5 to 4.0 mmϕ and a thickness of 2.0 to 6.0 mm because a Fe-Cr-Co magnet having a diameter of less than 1.5 mmϕ or a thickness of less than 2.0 mm cannot be provided with a sufficient magnetic flux to be used in the magnet ring of a STC and it is difficult to obtain such a shape of Fe-Cr-Co magnet provided with an absolute temperature coefficient value of less than 0.05%/°C. which is a necessary characteristic to magnet rings in a STC.

To the contrary, a STC would become too big to be used in combination with other devices in a practical CRT if an outer diameter of magnets incorporated in the STC exceeds 4.0 mmϕ or the thickness of the STC exceeds 6.0 mm. Because of the above stated reasons, it is necessary for the magnets used in a ring of a diameter of 1.5 to 4.0 mmϕ and a thickness of 2.0 to 6.0 mm. Preferably, the ratio of the magnet thickness to the outer diameter of the magnet should be 1.4 to 2.7.

Although the above explained embodiments of the invention concern cylindrical shaped magnets, rectangular shaped magnets also can be used in the ring magnets incorporated in a STC according to the invention if the magnets have a cross section of 1.7 $mm^2$ to 12.6 $mm^2$. The preferable absolute temperature coefficient value is equal to or less than 0.01%/°C. and, more preferably equal to or less than 0.005%/°C. The advantages of using ring magnets for a STC having an absolute temperature coefficient value of equal to or less than 0.01%/°C. and more preferably 0.005%/°C. are stated below. As already explained, a magnet comprised of a Ba-ferrite type of plastic generally has a temperature coefficient of about −0.2%/°C., which causes a magnetic flux reduction of about 16% compared with the original magnetic flux, for a temperature change (ΔT) of 80° C.

The amount of reduction of magnetic flux in ring magnets in a STC theoretically causes about 0.64 mm of beam discrepancy in each case so that the needed correction amount for side beams by a STC is 4 mm. A CRT provided with such a degree of beam discrepancy is undesirable.

On the other hand, a STC incorporated with ring magnets having a temperature coefficient of equal to or less than 0.01%/°C. will result in high performance in a CRT because the beams discrepancy would be suppressed to a negligibly small value range which is less than 0.016 mm.

It is also possible to use a mixture of metallic magnet material and resin material for the ring magnets, provided that the metallic magnet material is Alnico magnet material, Fe-Cr-Co magnet material, or a mixture thereof, preferably having an absolute temperature coefficient value of 0.01 to 0.03%/°C.

These magnets can be produced by the following methods, for example.

First compound pellets are made from a hot blend of the magnet material and resin.

Before mixing with resin the magnet particles can be surface treated with a known coupling agent.

The surface treatment for magnetic particles can be performed by the preceeding steps followed by spraying the coupling agent on the magnetic particles during stirring, mixing the particles thereafter, and drying. In this case, the resin can contain lubricant material and/or plastic agent.

The compound obtained according to the above described process would be ejected into a cavity surrounded by metal dies as a hot melt and taken out of the cavity after the ejection and then cooling. The obtained magnet body can be a four-pole magnet ring after magnetization without a further processing, but it is also possible to finish the magnet body at the outside wall thereof.

Although there is no limitation of the weight ratio of magnetic material to resin material from the standpoint of the temperature coefficient of magnetization, it is general practice to select the ratio of magnetic material to resin material of 50:50 to 95:5, preferably 80:20 to 90:10.

These ratios are preferable because a mixture containing too much magnetic material could not be formed into a magnet body and, to the contrary, the mixture containing too few magnetic materials could not be provided with sufficient magnetic properties. The preferable magnetic characteristics of a ring magnet according to the invention are the following:

Br (Residual Magnetic Flux) 2,900–3,000G,
Hc (Coersive Force) 700–800 Oe,
$(BH)_{MAX}$ (Maximum Energy Product) 0.6–0.8 MGOe.

The following polymer materials can be used as a bonding material for the permanent mgnetic powder: Thermoplastic resins such as Polyamide resin, Polyethylene, Polypropylene, Ethylene copolymer, ABS Resin, AS Resin, Polycarbonate, Polyethylene terephthalate, Polybutylene terephthalate; Thermosetting resins cuh as Phenolic plastic, alkyd resin; or other resins such as Styrene-butadiene rubber, Nitrile rubber, Ethylene-propylene rubber, Piparon, Acrylic rubber. The mentioned resins can be used by themselves or mixed with other resins as the bonding material.

DETAILED DESCRIPTION OF THE PREFERRED EMBODIMENTS

The following are the preferred embodiments of the present invention but other embodiments according to the present invention are also possible.

EXAMPLE 1

A four-pole magnet ring was constructed by insertion of four Fe-Cr-Co magnets, each of which has a shape of a diameter of 2.0 mmϕ and a thickness of 5.0 mm and magnetic characteristics of Br=8200G, Hc=4800e and $\alpha=+0.004\%/°C.$, into a plastic ring having an outer diameter of 46 mmϕ, an inner diameter of 34 mmϕ and a thickness of 2.7 mm, as shown in FIG. 5.

The magnetization directions of the magnets are also shown in the figure.

The six-pole magnet rings and the two-pole magnet rings, having an outer diameter of 46 mmϕ, an inner diameter of 34 mmϕ and a thickness of 1.4 mm, were made from a mixture comprising a Ba-ferrite material and plastic material (Hitachi KPM-3, $\alpha=-0.194\%/°C.$) and then by injection mold casting.

Each of these magnets was provided with a projection for easy rotation handling which is necessary for adjustments in a STC where electron beams emitted from the guns in a CRT were focused.

The STC comprising these magnets was incorporated into a CRT to measure the degree of shift of the beams by the magnetic field in the STC.

In this measurement we used a CRT where the distance between the side beams (Blue beam and Red beam) was 4.2 mm measured at the viewing screen in the absence of the STC. The maximum beam shift of 5.9 mm was obtained by a relative rotation of the four-pole magnet rings incorporated with the Fe-Cr-Co magnets which is sufficiently effective to shift the beams by the STC. The discrepancy of the beams caused by temperature variation was only 0.1 mm after a temperature rise of 80° C.

EXAMPLE 2

Each of the four-pole magnet rings was constructed by fixing four Alnico magnets, each of which has a diameter of 2.0 mmϕ, a thickness of 5.0 mm, Br=7400G, Hc=530 Oe and, $\alpha=-0.016\%/°C.$, at the pole positions of a plastic ring having the same shape as shown in Example 1. Similar measurements were performed using a CRT having the four-pole magnet rings according to this example, together with the six-pole magnet rings and two-pole magnet rings as used in Example 1.

The maximum shift of the side beams by the STC was 5.7 mm and we could focus the three beams to a point on a viewing screen.

The degree of discrepancy of the side beams caused by a temperature rise of 80° C. was 0.2 mm.

EXAMPLE 3

An Alnico magnet (Hitachi YCM-4D having magnetic properties of Br=6, 150G, Hc=1,130 Oe and $(BH)_{MAX}$=2.5MGOe) was mechanically pulverized to form magnet particles of less than 100 mesh and the particles were heat-treated at a temperature of 400° C. for 30 minutes in an Ar-gas atmosphere.

In succession, the 5 kg weight magnet particles were sprayed with 75 g weight of Silane coupling agent (Shinetsu Chemical KBM-603), during ten minutes of mixing in a Henshell-Mixer. The surface treatment for the magnet material was accomplished by drying the coated particles at a temperature of 100° C. for 60 minutes. A compound was obtained by a kneader mixing of 4.4 kg weight of the magnetic alloy particles and 308 g of Nylon 12 (Ube-Kosan, P-3014U) pellets.

The obtained compound was heated at a temperature of 295° C. and then injected into a cavity formed in dies having an outer diameter of 46 mmϕ, an inner diameter of 34 mmϕ and a thickness of 1.7 mm. The injection mold casting was performed in dies heated to a temperature of 80° C., under an injection pressure of 800 kg/cm$^2$.

Figure 6A:
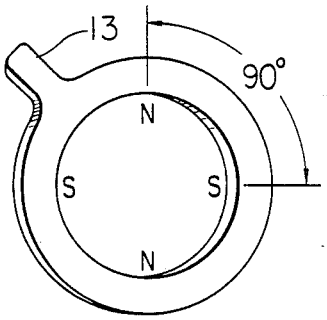
FIGS. 6*a*, 6*b* and 6*c* are views of magnet rings in accordance with another embodiment of the invention.
Figure 6B:
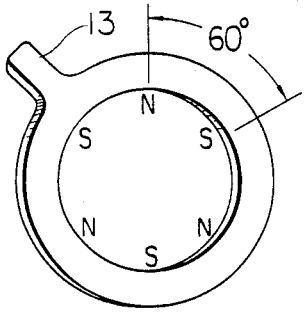
Figure 6C:
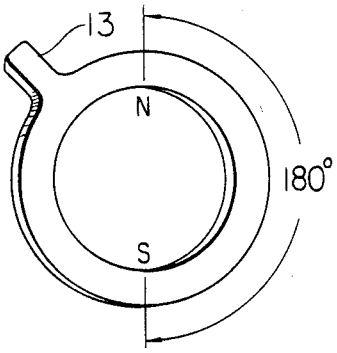

After the injection mold casting the obtained magnets were magnetized according to the directions shown in FIG. 6.

The composite magnets had magnetic characteristics of Br=3,050G, Hc=760 Oe, $(BH)_{MAX}$=0.7 MGOe and a temperature coefficient of $\alpha=-0.020\%/°C$.

The six-pole magnet rings and the two-pole magnet rings were made from a mixture of Ba-ferrite material and a resin material (Hitachi KPM-3).

These latter magnet rings each had an outer diameter of 46 mmϕ, an inner diameter of 34 mmϕ and a thickness of 1.4 mm. Each magnet was magnetized as usual to have six poles or two poles and then paired.

Each magnet was provided with a projection 13 for easy relative rotation as shown in FIG. 5.

The measurements of the degree of shift of the beams emitted from the gun in a CRT were conducted using a CRT incorporated with the STC comprising these magnets produced according to the above described process.

The reference CRT which was used to test the STC as constructed above was the same as one used in Example 1.

The following experimental results were obtained. The maximum shift amount of the electron beams was 5.85 mm at various locations in the four-pole magnet rings. The embodied complex magnets comprising Alnico particles were sufficiently effective to shift the beams incorporated in the STC. The temperature rise in a STC of 80° C. caused about 0.15 mm of color discrepancy in the side beams which is negligibly small for a practical CRT.

EXAMPLE 4

In this example four-pole magnet rings, six-pole magnet rings and also two-pole magnet rings were produced by insertion of Alnico magnets (Br=7400G, Hc=530 Oe), having an outer diameter of 2.0 mmϕ, and a thickness of 5.0 mm, into a plastic ring by a similar method as for the four-pole magnet rings as described in Example 1. The measurements were performed using the CRT incorporated with these magnet rings, which was the same as used in Example 1.

The experimental results showed that the maximum shift amount of the side beams was 5.70 mm and the three beams were focused to a point on a viewing screen. The color discrepancy of the side beams was 0.15 mm after a temperature rise of 80° C.

EXAMPLE 5

Magnet particles were obtained by a heat treatment of 400° C.×30 minutes in Ar-gas atmosphere of Alnico particles of less than 100 mesh which were produced by mechanical pulverization of Alnico block (Hitachi YCM-4D, having Br=6,150G, Hc=1130 Oe and $(BH)_{MAX}$=2.5MGOe).

The 5 kg weight of magnet particles were sprayed with 75 g of Silane coupling agent (Shinetsu Chemical KBM-603) during their stirring in a Henshell-Mixer and they were again mixed for ten minutes after the spray, then dried at 100° C. for 60 minutes to finish the surface treatment.

A compound was produced by a kneader mixing of 4.4 kg of the surface treated magnet particles and 308 g of Nylon 12 (Ubekosan, P-3014U) pellets.

The hot compound, at a temperature of 295° C., was used to form magnet rings in a cavity, having an outer diameter of 46 mmϕ, an inner diameter of 34 mmϕ and a thickness of 1.7 mm, whose shape can be understood by FIG. 6, by injection mold casting at an injection pressure of 800 kg/cm$^2$ in the cavity formed by heat controlled dies.

The magnets produced by the above stated method were magnetized to have four poles, each neighboring pole forming an angle of 90 degrees as shown by FIG. 5.

Six-pole ring magnets and two-pole ring magnets as shown in FIGS. **6*b* and 6*c*** were also produced by a similar injection process as the one to produce the mentioned four-pole ring magnets. These magnetized magnet rings were provided with magnetic characteristics of Br=3,050G, Hc=760 Oe, and $(BH)_{MAX}$=0.70MGOe.

These magnets were installed with their projection for easy rotation during adjustments to the STC, as shown in FIG. 6.

The shift amounts of the side beams by a STC comprising these magnet rings were measured after they were incorporated in the STC of the CRT. The CRT provided with the magnet rings produced in this example was the same as used in Example 1.

The maximum shift amount 5.80 mm of the side beams was obtained by the relative location of the magnets in the paired four-pole magnet rings. It was confirmed that the paired magnet rings comprising Alnico magnet particles and the resin material fulfilled their functions in the STC at room temperature.

The measured discrepancy of the side beams caused by a temperature rise of 80° C. was 0.10 mm.

EXAMPLE 6

Four-pole magnets, six-pole magnets and two-pole magnets were produced by insertion of Fe-Cr-Co magnets each having an outer diameter of 2.5 mmϕ and a length of 4.0 mm, at the pole positions of each plastic ring having the same shape as shown in Example 1. The CRT incorporated with the STC comprising these magnets produced was used to measure the beam shift amounts.

As the maximum shift amount of the side beams was 5.05 mm by the STC comprising these plastic rings incorporated with pole magnets of Fe-Cr-Co having a mean magnetic flux 59.4 Mx, the target of the magnetic flux to be provided to the Fe-Cr-Co magnets was 60.0 Mx.

EXAMPLE 7

Various shapes of pole magnets of Fe-Cr-Co magnet material were produced. The Fe-Cr-Co magnets had characteristics of Br=8,200–8,350G and Hc=440–465 Oe. The results of the measurements are shown in Table 1.

TABLE 1

| No. | Diameter (mmϕ) | Length (mm) | Temp. Coefficient (%/°C.) | Evaluation | Magnetic Flux (Mx) | Evaluation | Total Evaluation |
|---|---|---|---|---|---|---|---|
| 1 | 1.0 | 2.0 | −0.001 | ○ | 21.8 | | |
| 2 | " | 5.0 | +0.024 | | 45.4 | | |
| 3 | 1.5 | 2.0 | −0.007 | | 30.6 | | |
| 4 | " | 3.0 | −0.001 | ○ | 46.3 | ○ | ◎ |
| 5 | 1.5 | 4.0 | +0.005 | ○ | 65.3 | ○ | ◎ |
| 6 | " | 5.0 | +0.013 | | 78.7 | ○ | ◎ |
| 7 | 2.0 | 3.0 | −0.005 | ○ | 60.4 | ○ | ◎ |
| 8 | " | 4.0 | −0.001 | | 89.0 | ○ | |
| 9 | 2.0 | 5.0 | +0.004 | ○ | 111.6 | ○ | |
| 10 | " | 6.0 | +0.009 | ○ | 123.6 | ○ | ◎ |
| 11 | 2.5 | 3.0 | −0.008 | | 72.6 | ○ | ◎ |
| 12 | " | 4.0 | −0.004 | ○ | 102.9 | ○ | ◎ |
| 13 | " | 5.0 | −0.001 | | 133.7 | ○ | |
| 14 | " | 6.0 | −0.003 | ○ | 159.6 | ○ | |
| 15 | 3.0 | 3.0 | −0.011 | | 86.6 | ○ | |
| 16 | " | 4.0 | −0.007 | ○ | 118.3 | ○ | ◎ |
| 17 | 3.0 | 5.0 | −0.003 | | 161.7 | ○ | |
| 18 | 3.5 | 3.0 | −0.013 | | 95.2 | ○ | ◎ |
| 19 | " | 5.0 | −0.005 | ○ | 174.9 | ○ | |
| 20 | 4.0 | 3.0 | −0.014 | | 102.5 | ○ | |
| 21 | " | 5.0 | −0.008 | ○ | 182.8 | ○ | |
| 22 | 4.0 | 6.0 | −0.005 | ○ | 241.4 | ○ | ◎ |
| 23 | 4.5 | 3.0 | −0.016 | | 111.2 | ○ | |
| 24 | " | 5.0 | −0.009 | | 202.7 | ○ | |

The temperature coefficients of magnetization were measured by a vibrating type magnetometer in a temperature variation range of 0° C. to 120° C. The data in Table 1 are mean reversible temperature coefficients.

The ○ evaluation symbol signifies each shape having a temperature coefficient the absolute value of which is equal to or less than 0.005%/°C.

The magnetic fluxes were measured on the magnets after a sufficient magnetization. Shapes having magnetic fluxes of equal to or more than 60.0 Mx were designated evaluation with ○ symbols according to the experimental results.

The ○ symbols in the total evaluation column signify excellent magnets having both a magnetic flux of equal to or more than 60.0 Mx and a temperature coefficient of equal to or less than 0.005%/°C.

EXAMPLE 8

Magnet rings were produced by insertion of Fe-Cr-Co magnets having a sufficient magnetic flux and a small temperature coefficient, into a plastic ring having a shape with an outer diameter of 48 mmϕ, an inner diameter of 34 mmϕ and a thickness of 4.2 mm.

Figure 5A:
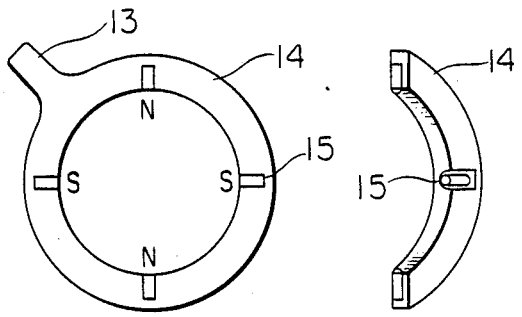
FIGS. 5*a*, 5*b* and 5*c* are both front view and partially exploded view of the magnet rings used in the invention.
Figure 5B:
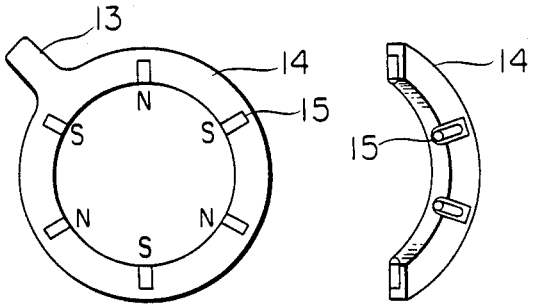
Figure 5C:
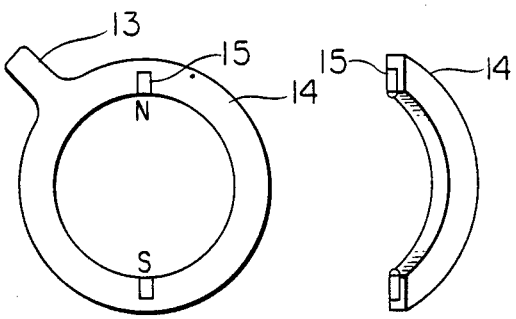

The locations of the inserted magnets in the four-pole magnet are shown in FIG. 5*a*. The locations of the inserted magnets in the six-pole magnet and the two-pole magnet are shown in FIGS. 5*b* and 5*c*, respectively.

The measurement of the CRT incorporated with the produced magnet rings were performed by a similar method as in Example 1.

The maximum shift amount of the side beams ranged from 5.05 mm by a STC incorporated with No. 2 sample to 16.70 mm by a STC incorporated with No. 10 sample, and in each case it was possible to focus the three beams at a specific point by adjustments of four-pole magnet rings and six-pole magnet rings.

The maximum color discrepancy of beams caused by a temperature rise of the STCs was at most 0.05 mm which is sufficiently small for an actual picture tube.

These experimental results are shown in Table 2.

TABLE 2

| No. | Diameter (mm) ϕ | Length (mm) | Max. beam shift (mm) | Color Discrepancy (mm) |
|---|---|---|---|---|
| 1 | 1.5 | 4.0 | 5.45 | ≦0.05 |

TABLE 2-continued

| No. | Diameter (mm) $\phi$ | Length (mm) | Max. beam shift (mm) | Color Discrepancy (mm) |
|---|---|---|---|---|
| 2 | 2.0 | 3.0 | 5.05 | " |
| 3 | " | 4.0 | 7.55 | " |
| 4 | 2.0 | 5.0 | 9.60 | " |
| 5 | 2.5 | 4.0 | 8.90 | " |
| 6 | " | 5.0 | 11.40 | " |
| 7 | 2.5 | 6.0 | 13.35 | " |
| 8 | 3.0 | 5.0 | 13.40 | " |
| 9 | 3.5 | 5.0 | 14.20 | " |
| 10 | 4.0 | 6.0 | 16.70 | " |

COMPARISON EXAMPLE

We produced two-pole magnets, four-pole magnets and six-pole magnets using bonded magnets (Hitachi KPM-3), a mixture of Ba-ferrite material and plastic material.

They had the same shape, namely an outer diameter of 46 mm$\phi$, an inner diameter of 34 mm$\phi$, and a thickness of 1.4 mm. The magnetizations for them were performed as each neighboring pole forms an equal angle in each magnet ring. The maximum shift amount of the side beams was 5.30 mm but the color discrepancy caused by a temperature rise in the STC incorporated in the Ba-ferrite type of bond magnets, was 0.65 mm after a temperature rise of 80° C.

As explained above, a color CRT where the color discrepancy of beams is small can be achieved according to the present invention, because the STC incorporated in the CRT comprises a magnet ring which is plastic ring having pole magnets where metallic magnets are inserted at the pole positions, or a plastic magnet where magnet particles are bonded with an agent such as a resin, wherein the magnet material has an absolute value of the temperature coefficient of magnetization of 0.05%/°C. or less.

What is claimed is:

1. A convergence device to focus three electron beams emitted from guns located at a bottom position of a color picture tube to a point on a viewing screen comprises a pair of four-pole magnet rings, a pair of six-pole magnet rings and a pair of two-pole magnet rings mounted on a neck of an in-line, tri-beam shadow-mask color picture tube, wherein at least the pole portions of the pair of four-pole magnet rings comprise permanent magnetic material, the absolute value of the temperature coefficient of magnetization of which is equal to or less than 0.05%/°C. measured in a temperature range of 0° C. to 120° C.

2. A convergence device according to claim 1 wherein all said paired magnet rings have the pole portions comprise permanent magnetic material having the absolute value of the temperature coefficient of magnetization of equal to or less than 0.05%/°C.

3. A convergence device according to claim 1 or 2 wherein said permanent magnetic material is Alnico magnetic material.

4. A convergence device according to claim 1 or 2 wherein said permanent magnetic material is Fe-Cr-Co magnetic material.

5. A cionvergence device according to claim 1 or 2 wherein said four-pole magnet rings comprise a mixture of metallic magnetic material and polymer material as permanent magnetic material.

6. A convergence device according to claim 4 wherein said Fe-Cr-Co magnetic material is provided with an absolute temperature coefficient of magnetization which is equal to or less than 0.01%/°C. measured in a temperature range of 0° C. to 120° C.

* * * * *